US005129342A

United States Patent [19]

Wirth et al.

[11] Patent Number: 5,129,342

[45] Date of Patent: Jul. 14, 1992

[54] APPARATUS FOR FEEDING A TIE INSERT TO THE FEED TABLE OF A TIE SEWING MACHINE

[75] Inventors: Rudi Wirth, Schwarzenbach/Wald; Adolf Hägel, Bad Steben, both of Fed. Rep. of Germany

[73] Assignee: LIBA Maschinefabrik GmbH, Fed. Rep. of Germany

[21] Appl. No.: 573,834

[22] Filed: Aug. 27, 1990

[30] Foreign Application Priority Data

Sep. 1, 1989 [DE] Fed. Rep. of Germany ..... 3929100

[51] Int. Cl.[5] ..... D05B 33/00

[52] U.S. Cl. ..... 112/303; 112/121.22

[58] Field of Search ..... 112/121.22, 121.15, 112/121.29, 104, 113, 303, 262.3; 271/23, 19, 18.3, 268, 131, 82, 85, 314

[56] References Cited

U.S. PATENT DOCUMENTS

| | | | |
|---|---|---|---|
| 4,008,888 | 2/1977 | Vinciguerra | 271/18.3 |
| 4,157,692 | 6/1979 | Brocklehurst et al. | 271/23 X |
| 4,372,549 | 2/1983 | Stiernspetz | 271/23 |
| 4,444,384 | 4/1984 | Keeton | 271/18.3 |
| 4,526,363 | 7/1985 | Fort | 271/18.3 X |
| 4,613,123 | 9/1986 | Franke | 271/18.3 |
| 4,905,617 | 3/1990 | Small | 112/121.22 |

FOREIGN PATENT DOCUMENTS

| | | | |
|---|---|---|---|
| 1803970 | 5/1969 | Fed. Rep. of Germany . | |
| 2407941 | 8/1974 | Fed. Rep. of Germany . | |
| 3237034 | 2/1988 | Fed. Rep. of Germany . | |
| 8906446 | 8/1989 | Fed. Rep. of Germany . | |
| 405899 | 7/1966 | Switzerland . | |
| 1406103 | 6/1988 | U.S.S.R. | 271/18.3 |

*Primary Examiner*—Peter Nerbun

*Attorney, Agent, or Firm*—Bell, Seltzer, Park & Gibson

[57] ABSTRACT

A device for feeding a tie stiffening or other article to the supporting table 2 of a sewing machine includes a container 19 for said articles provided above the supporting table 2. The container 19 has a window 21 which extends along its bottom and under which there is disposed a withdrawal device 6 with needles 27, 28 which sink in opposite directions into the currently lowest layer 22 of the stack, substantially transversely of the window, which layer, after the needles have sunk in, is withdrawn from the stack, turned through 180° and deposited on the supporting table when the needles are pulled out. The withdrawal device is turned by means of a pair of pinions 10 which encounter a pair of stationary racks 11 during lowering.

3 Claims, 2 Drawing Sheets

APPARATUS FOR FEEDING A TIE INSERT TO THE FEED TABLE OF A TIE SEWING MACHINE

The invention relates to a device for feeding articles such as necktie stiffening to the supporting table of a sewing machine. For convenience, the following description is made with reference to sewing neckties, but the invention is not limited thereto.

In tie sewing machines hitherto in use, a tie stiffening is laid on the supporting table of the tie sewing machine by hand. By means of a displacement movement of the supporting table, the tie stiffening is then brought together with a tie cut-out, which has been folded in the meantime, and is sewn to this by a longitudinal seam.

It is the object of the invention to automate the feed of the tie stiffening or other articles to the supporting table in order to relieve the machine operator from this operation, whereby the working cycle of the machine can be speeded up.

According to the invention, there is provided a device for feeding an article to a supporting table of a sewing machine, wherein a container is provided above the supporting table, serving to receive a stack of said articles and having a window extending along its bottom, under which window there is disposed a withdrawal device which can be lowered to the supporting table along guides and has means to engage the currently lowest layer of the stack and on lowering pulls the lowest layer away from the stack, a turning movement being superimposed on the lowering movement of the withdrawal device in such a manner that the layer is turned over so as to be deposited on the supporting table upon disengagement of the engaging means.

More particularly the invention provides a device for feeding a tie stiffening to the supporting table of a necktie sewing machine, wherein a container is provided above the supporting table, serving to receive a stack of tie stiffenings and having a window extending along its bottom under which window there is disposed a withdrawal device which can be lowered to the supporting table along slide bars and has pins for piercing into the currently lowest layer of the stack, which pins are made arcuate and in use are movable in opposite directions on the ends of pivoted arms, to sink into the layer substantially transversely of the window and, on vertical lowering, the withdrawal device pulls the lowest layer away from the stack, a turning movement being superimposed on the lowering movement of the withdrawal device in such a manner that the layer is turned over so as to be deposited on the supporting table upon disengagement of the engaging means.

The arrangement of the container with the stack of articles above the supporting table is favourable because here there is room available and the container is easily accessible for refilling. The problem of withdrawing the currently lowest layer of the stack present in the container can be solved advantageously by providing the withdrawal device with pins which can engage through the window present in the bottom of the container and sink into the currently lowest layer which is thus gripped by the withdrawal device. The withdrawal, turning and depositing on the supporting table then follow on the grasping of the currently lowest layer.

The pins may appropriately be made arcuate and are disposed at the ends of pivoted arms which are mounted on the withdrawal device for opposed movement like pincers.

One embodiment of the invention is illustrated by way of example in the drawings, to which the following description refers, and in which.

Figure 1:
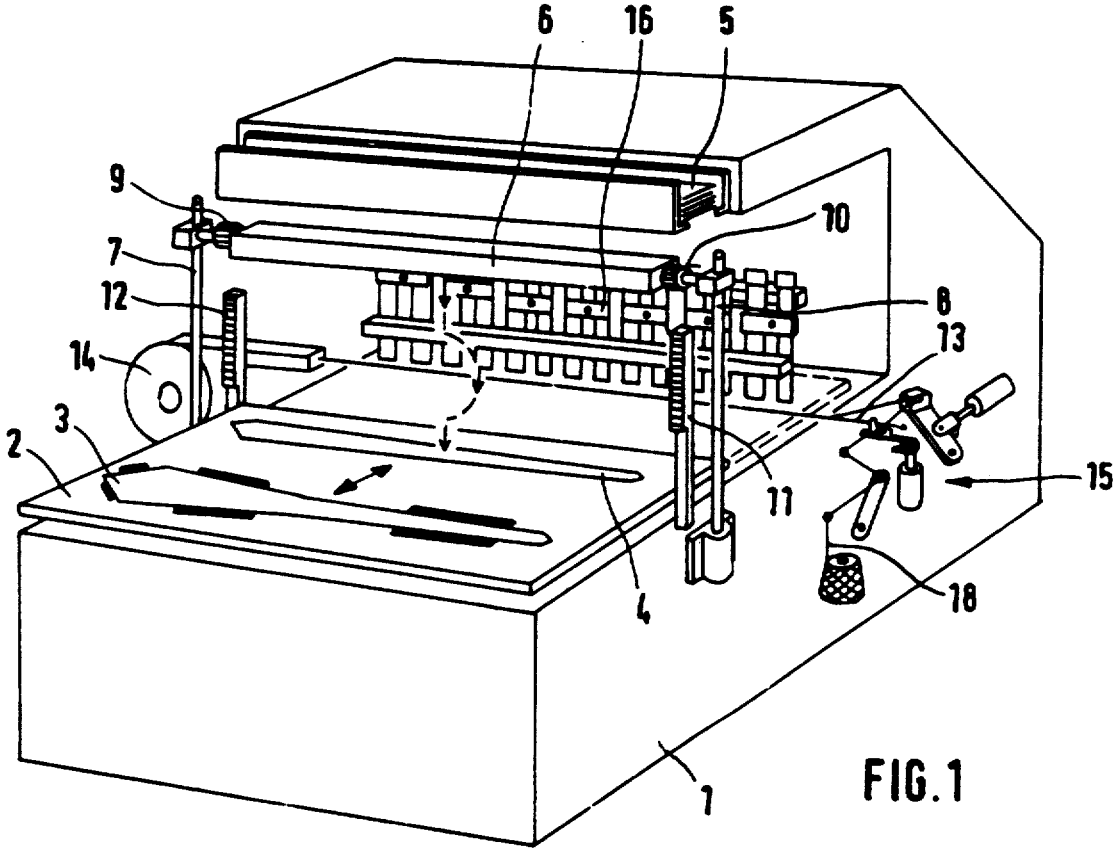
FIG. 1 shows a perspective view of a tie sewing machine.

The tie sewing machine illustrated in FIG. 1 consists of a machine frame 1 on which the supporting table 2 is mounted for displacement as indicated by the double headed arrow.

The tie cut-out 3 and the tie stiffening 4 are laid on the supporting table 2. A tie cut-out 3 and a tie stiffening 4 are brought together by a displacement movement which is not material to the invention and are brought into the sewing position. Before the sewing operation, the tie cut-out 3 is folded by means of the folding sword 16 which is movable vertically up and down. Apparatus for folding the cut-out is described and claimed in our co-filed application entitled "Cut-out Folding Device" Agent's ref. BP-08-0602.

The tie stiffening 4 is taken from a stack 5 by the withdrawal device 6 which grasps the currently lowest layer of the stack 5 and deposits it on the supporting table 2 for which purpose the withdrawal device 6 executes a rotational movement through 180° indicated in FIG. 1 by the broken line provided with arrowheads. This rotational movement comes about as a result of the fact that the withdrawal device 6 is mounted for displacement on slide bars 7 and 8 and carries two pinions 9 and 10 which encounter two racks 11 and 12 during the downward movement of the withdrawal device 6, as a result of which the withdrawal device 6 executes the rotational movement through 180° during its further downward movement. During the subsequent upward movement the reverse sequence of movements occurs.

A sewing needle 13 consists of high-strength spring steel wire which is wound on a needle drum 14 in the retracted position of the needle 13. In order to thread a sewing thread 18, the needle 13 is pushed out of the needle drum, 14 and finally arrives with its point in the region of a threading device 15 out of which it is withdrawn again to carry out the sewing operation, the wire of the needle 13 being wound on the needle drum 14. In the course of this, the needle 13 runs up a longitudinal seam, the position of which corresponds to the needle 13 shown in FIG. 1. A method of and apparatus for threading the needle is described and claimed in our co-filed application entitled "Threading Needles" Agent's ref. BP-08-0595.

The sewing operation is effected in known manner in that, during the advance of the needle 13 from the needle drum 14 to the threading device 15, the needle 13 pierces through the material of tie cut-out 2 and tie stiffening 4, which is held undulated, so that when the needle 13 is withdrawn with the sewing thread 18 threaded, the latter is pulled through the sewing thread 18 threaded, the latter is pulled through the material in accordance with the undulating shape to sew the parts in question together. This is also a known operation.

Figure 2:
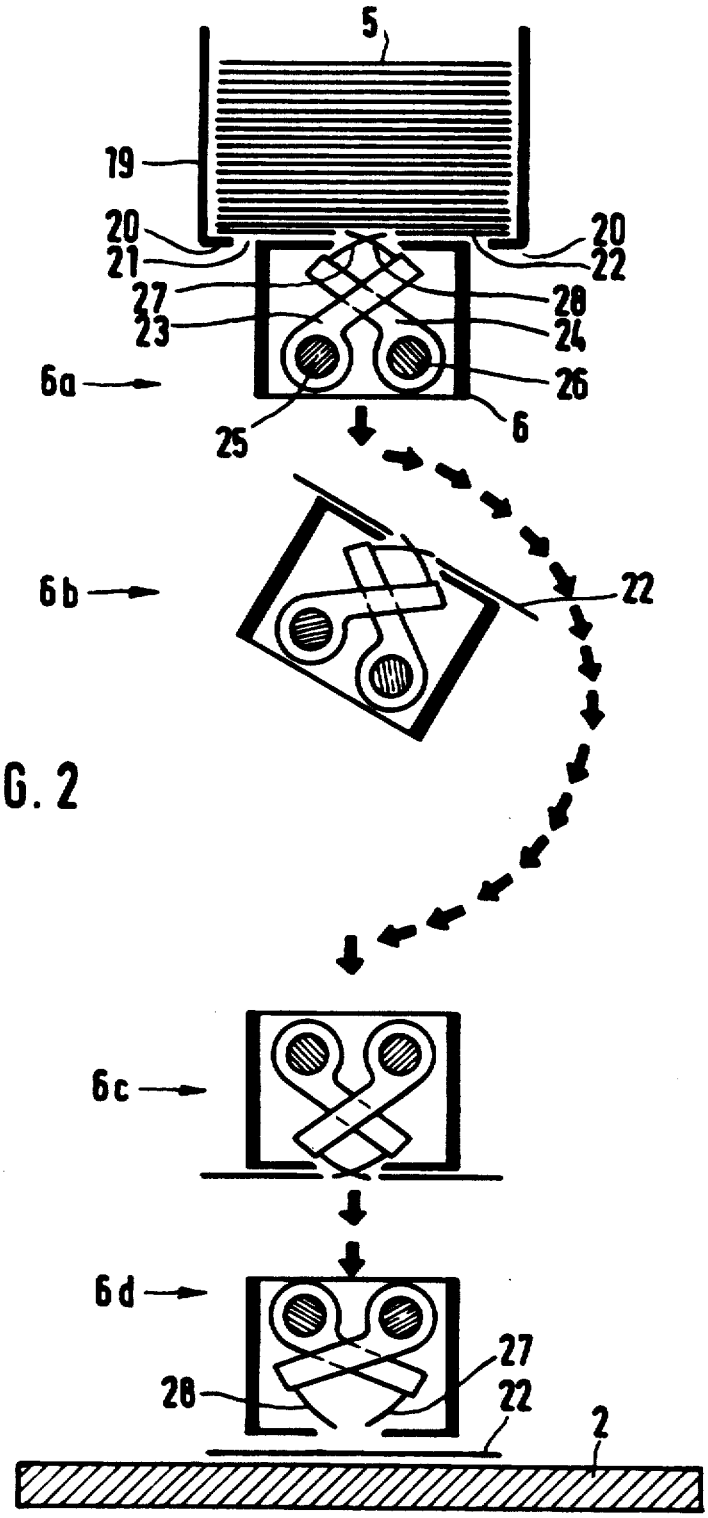
FIG. 2 shows, in a diagrammatic illustration, the withdrawal device with the movement executed thereby.

The construction of the withdrawal device and its motion are illustrated diagrammatically in FIG. 2. The withdrawal device 6 is illustrated in four successive positions which are designated by 6*a*, 6*b*, 6*c* and 6*d*. According to the position 6*a*, the withdrawal device 6 is disposed below the container 19 which contains the stack 5 of tie stiffeners. The container 19 has a window 21 which is provided along its bottom 20 and through which the withdrawal device can engage according to position 6a. The lowest layer of the stack 5 is designated by 22.

The withdrawal device 6 comprises two pivoted arms 23 and 24 which are secured to two longitudinal shafts 25 and 26. Thus when the pivot shafts 25 and 26 are turned, the pivoted arms 23 and 24 turn with them accordingly. The pivot shafts 25 and 26 extend over the whole length of the withdrawal device 6 (see FIG. 1). A large number of pivoted arms 23 and 24 are accommodated side by side in the withdrawal device 6, and are turned in unison by rotation of the pivot shafts 25 and 26.

Secured to the ends of each of the pivoted arms 23 and 24 are arcuate pins 27 and 28 which, when the pivoted arms 23 and 24 are turned in a pincer-like manner, execute opposite piercing movements. This piercing movement is already completed in the position 6a since, as can be seen, the two pins 27 and 28 cross one another in this position. The pins 27 and 28 reach out of the withdrawal device 6 and through the window 21 in the container 19 and as the turning movement of the pivoted arms 23 and 24 progresses, they sink into the lowest layer 22 of the stack 5, substantially in the direction of the plane of the layer 22, transversely of the container 19, and so grip this lowest layer 22. Since the material of tie stiffenings normally consists of a relatively open weave, the lowest layer 22 can be reliably grasped by the pins 27 and 28 without there being any danger of the layer above being also grasped.

After the lowest layer 22 has been grasped, it is to some extent connected to the withdrawal device which is then lowered vertically in accordance with the arrow shown (see also FIG. 1) until the pinions 9 and 10 described in connection with FIG. 1 encounter the racks 11 and 12 whereupon the turning operation through 180° described in connection with FIG. 1 is effected, which is likewise indicated by the arrows in FIG. 2. In the course of this, the withdrawal device 6 passes through the position 6b in which the withdrawal device 6 is partially turned, taking with it the layer 22.

On the further travel of the withdrawal device 6, it finally reaches the position 6c in which it has turned through 180° in comparison with the position 6a. The arrows drawn in FIG. 2 are intended to represent (enlarged) the movement which the pins 27 and 28 execute.

After reaching the position 6c, the withdrawal device 6 is lowered further vertically until it stops close above the supporting table 2 where the pivoted arms 23 and 24 are then moved back like pincers in the course of which the pins 27 and 28 move away from one another and are thus pulled out of the layer 22. The layer 22 is thus released from the withdrawal device 6 and falls onto the supporting table 2.

After the transfer of the layer 22 from the stack 5 to the supporting table 2, the withdrawal device 6 is returned to the initial position 6a during which, under the action of the pinions 9 and 10 and the racks 12 and 13 represented in FIG. 1, a corresponding return movement results for the withdrawal device 6.

We claim:

1. An apparatus for feeding a tie stiffening to a supporting table of a necktie sewing machine, and comprising:

an elongate holding container positioned above the supporting table, and adapted for receiving a stack of tie stiffenings therein, said holding container including a longitudinal opening extending along the bottom portion thereof, a pair of spaced, vertically oriented slide bars positioned adjacent the supporting table and extending upward to the holding container, an elongate withdrawal mechanism slidably mounted on the spaced, vertically oriented slide bars, and movable from a raised position located underneath the opening of the elongate holding container to a lowered position adjacent to and above the supporting table, said withdrawal mechanism including a pair of gripper arms pivotably mounted within the withdrawal mechanism, said gripper arms being pivotably movable toward each other, an arcuate configured pin mounted onto each gripper arm and being oriented and dimensioned so that upon pivotable movement of the gripper arms, the pins cross each other and the tips of the pins are oriented in a substantially planar configuration when tangentially contacting the lowermost tie stiffening positioned within the holding container for grasping the lowermost tie stiffening positioned within the holding container without grasping the second bottom-most tie stiffening held within the holding container, and means operatively connected to the withdrawal mechanism for imparting a turning movement to the withdrawal mechanism as the withdrawal mechanism is lowered on the sliding bars so that a tie stiffening grasped by the pins is turned over and deposited on the supporting table upon disengagement of the pins with the tie stiffening.

2. The apparatus according to claim 1 and further including a vertically oriented gear rack and wherein said withdrawal mechanism includes a pinion that encounters the rack during lowering movement of the withdrawal mechanism to cause the turning movement of the withdrawal mechanism.

3. The apparatus according to claim 1 and further including a pair of support shafts rotatably mounted within the withdrawal mechanism, and wherein a gripper arm is secured onto each support shaft.

* * * * *